US005722474A

United States Patent [19]

Raybon et al.

[11] Patent Number: 5,722,474

[45] Date of Patent: Mar. 3, 1998

[54] METHOD AND APPARATUS FOR CUTTING A CANT INTO BOARDS

[76] Inventors: Christopher Raybon, 737 Old Brundage Rd., Hot Springs, Ark. 71913; Levi A. Pollard, V, 3310 Scotts Ferry Rd., Appling, Ga. 30802; Ronald W. McGehee, 537 Parducci Rd., Ukiah, Calif. 95482; Russell R. Kennedy, 723 Rock Creek Rd.; Patrick M. Conry, 304 Redbird Pl., both of Hot Springs, Ark. 71913

[21] Appl. No.: 635,189

[22] Filed: Apr. 19, 1996

[51] Int. Cl.[6] ..... B27B 1/00

[52] U.S. Cl. ..... 144/357; 144/3.1; 144/39; 144/378; 144/250.23; 83/368

[58] Field of Search ..... 83/368, 370, 371; 144/3.1, 39, 41, 329, 356, 357, 376, 377, 378, 242.1, 250.23

[56] References Cited

U.S. PATENT DOCUMENTS

| | | | |
|---|---|---|---|
| 3,960,041 | 6/1976 | Warren et al. | 144/357 |
| 4,449,557 | 5/1984 | Makela et al. | 83/368 |
| 4,485,861 | 12/1984 | Nilsson et al. | 144/39 |
| 4,711,279 | 12/1987 | Reuter | 144/39 |
| 5,143,127 | 9/1992 | Rautio | 144/39 |
| 5,396,938 | 3/1995 | Cannaday | 144/39 |
| 5,400,842 | 3/1995 | Brisson | 144/357 |
| 5,435,361 | 7/1995 | Knerr | 144/357 |

*Primary Examiner*—W. Donald Bray

*Attorney, Agent, or Firm*—Cushman Darby & Cushman Intellectual Property Group of Pillsbury Madison & Sutro LLP

[57] ABSTRACT

Apparatus for detecting dimensional information of a workpiece such as a canted log is used to control a gang saw mounted on a pivot axis to cut the log into substantially even thickness boards while moving the log past the cutting device and pivoting the gang saw to accommodate curvature in the log.

17 Claims, 9 Drawing Sheets

METHOD AND APPARATUS FOR CUTTING A CANT INTO BOARDS

FIELD OF THE INVENTION

The present invention relates to an apparatus for cutting a log that has been canted into boards while maximizing the production of the boards from logs with a higher production efficiency than has heretofore been possible. The invention also provides a method of operating the apparatus to optimize production and to provide boards of substantially uniform thickness even where the log exhibits a significant curvature along its longitudinal axis.

BACKGROUND OF THE INVENTION

With the increasing scarcity of lumber that is available for harvesting, it has become increasingly important that the apparatus employed to cut logs into boards be able to accommodate a greater variety of initial log shapes at a reasonable production speed so that logs that depart significantly from a straight longitudinal axis will be able to be harvested and efficiently cut into useful wood products. In the past, some attempts to accommodate dimensional deviations in a log have generally involved apparatus which discards a significant portion of the log so that the gang saws will be able to operate effectively on the remainder of the log. Other devices have attempted to modify the feed of the log to the gang saws. While these have improved the variety of logs that could be usefully harvested and cut into boards, the production efficiency of the prior art machines has suffered significantly where the cant or curvature of the log to be cut into boards has been severe.

SUMMARY OF THE INVENTION

The present invention avoids the difficulties of the prior gang saw machinery while providing a board saw apparatus which will operate with improved production capacity while assuring highly accurate cutting of a curved cant or multiple curve cant into boards of substantially more uniform thickness than has heretofore been possible.

In a preferred embodiment, the present invention utilizes a scanning station located at an upstream end of a log path relative to a downstream cutting tool. At the scanning station, the outer configuration of a canted log is read and the data provided to a computer operated with software for controlling the position of a gang saw relative to a substantially rectilinear path for the log. Thus, each incoming log will be scanned and a unique cutting solution for that log will be derived and utilized to control for each selected increment of length of the log the cutting position of the gang saw in correlation with the throughput speed of the transport conveyor for the log.

With this arrangement, logs which, due to deformities, were previously rejected for harvesting and cutting into boards or other wood products, will now be profitably handled with the apparatus and method of the present invention at the same throughput production speeds or even enhanced production speeds relative to what has previously been possible.

The foregoing and other advantages of the present invention will become apparent as consideration is given to the following detailed description taken in conjunction with the accompanying drawings, in which:

DETAILED DESCRIPTION OF THE INVENTION

Figure 1:
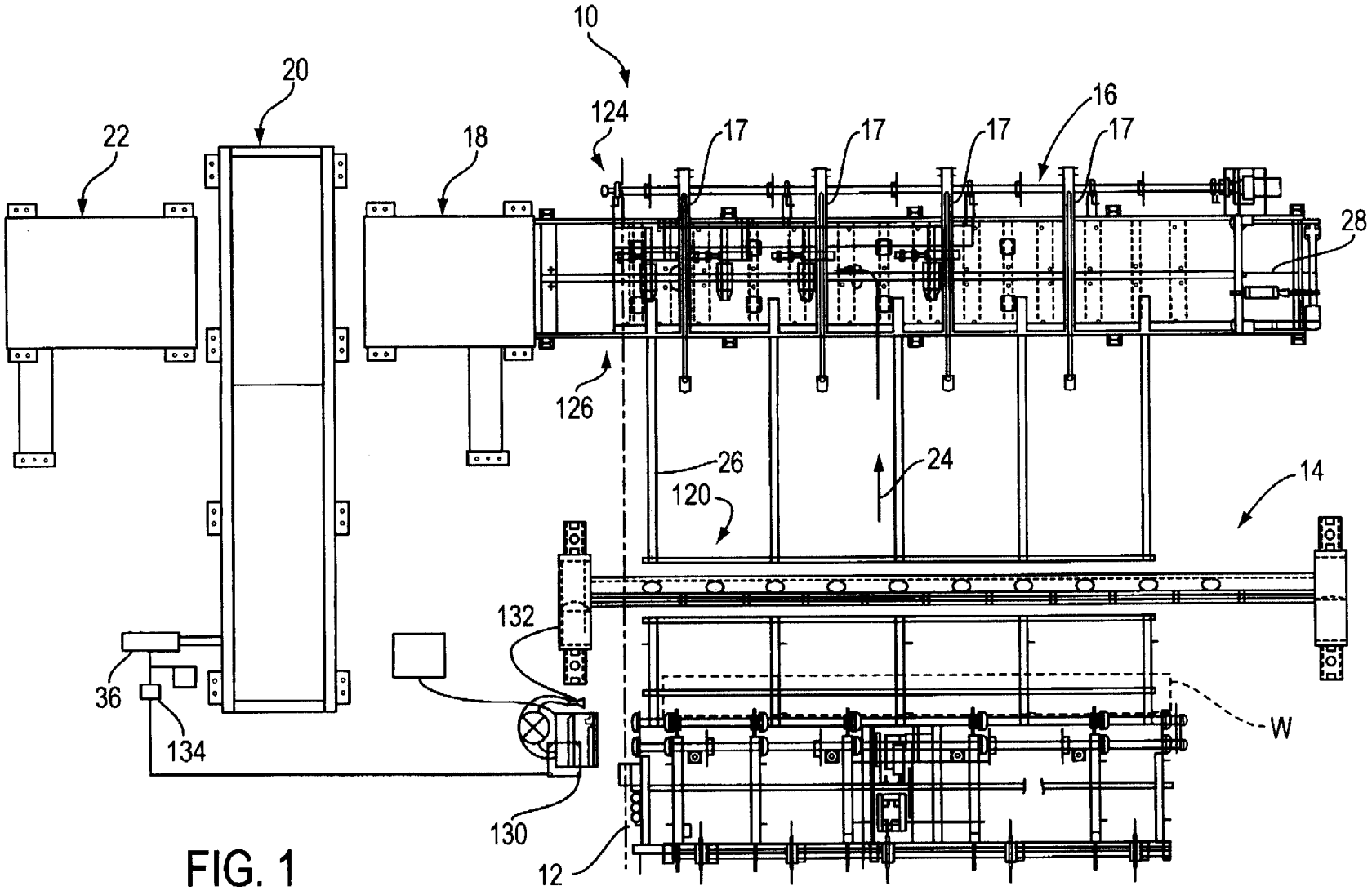
FIG. 1 is a schematic illustration in a top plan view of the apparatus of the present invention.

Referring now to the drawings wherein like numerals designate corresponding parts throughout the several views, there is shown in FIG. 1 the apparatus 10 of the present invention and which includes an infeed conveyor 12 which is of conventional construction and is designed and arranged to feed a log W from a supply source, align the log generally perpendicular to the direction of flow indicated by the arrow 24 through a scanning work station 14 and then to an aligning and infeed conveyor table 16. Typically, the conveyor 12 which extends through the scanning work station 14 will comprise a plurality of endless chain conveyors which are looped over pulleys, which may be driven by a single motor to assure even feeding of the workpiece log W through the various work stations of the apparatus 10. It is a provision of the present invention that once a log has been selected from the supply and fed to the infeed conveyor 12, the passing of the log through the various subsequent work stations will be automatic and the velocity of the workpiece will be strictly regulated to achieve maximum throughput capacity.

The feed table 16 includes manipulating equipment to align the log relative to a path of travel which is generally parallel to the longitudinal axis 28. Upon actuation of the feed mechanisms, as described below, for the feed table 16, the log will be fed to the left as viewed in FIG. 1 to a infeed module table 18 which, as described below, includes log gripping members schematically shown at 17 which precisely align the log relative to the path of travel indicated at 28 to assure uniform cutting of the log as the log is fed by the infeed module to the gang saw module 20. From the gang saw module 20, the log, now cut into boards, is fed by the mechanisms of the infeed module 18 to the outfeed module 22 where the boards are grasped by handling equipment to maintain the boards upright as cutting is completed at work station 20. The outfeed module 22 feeds the boards in a facing condition to a segregating table, if desired, downstream which will operate to divide the logs for separation according to length and subsequent storage or other finishing equipment.

Figure 2:
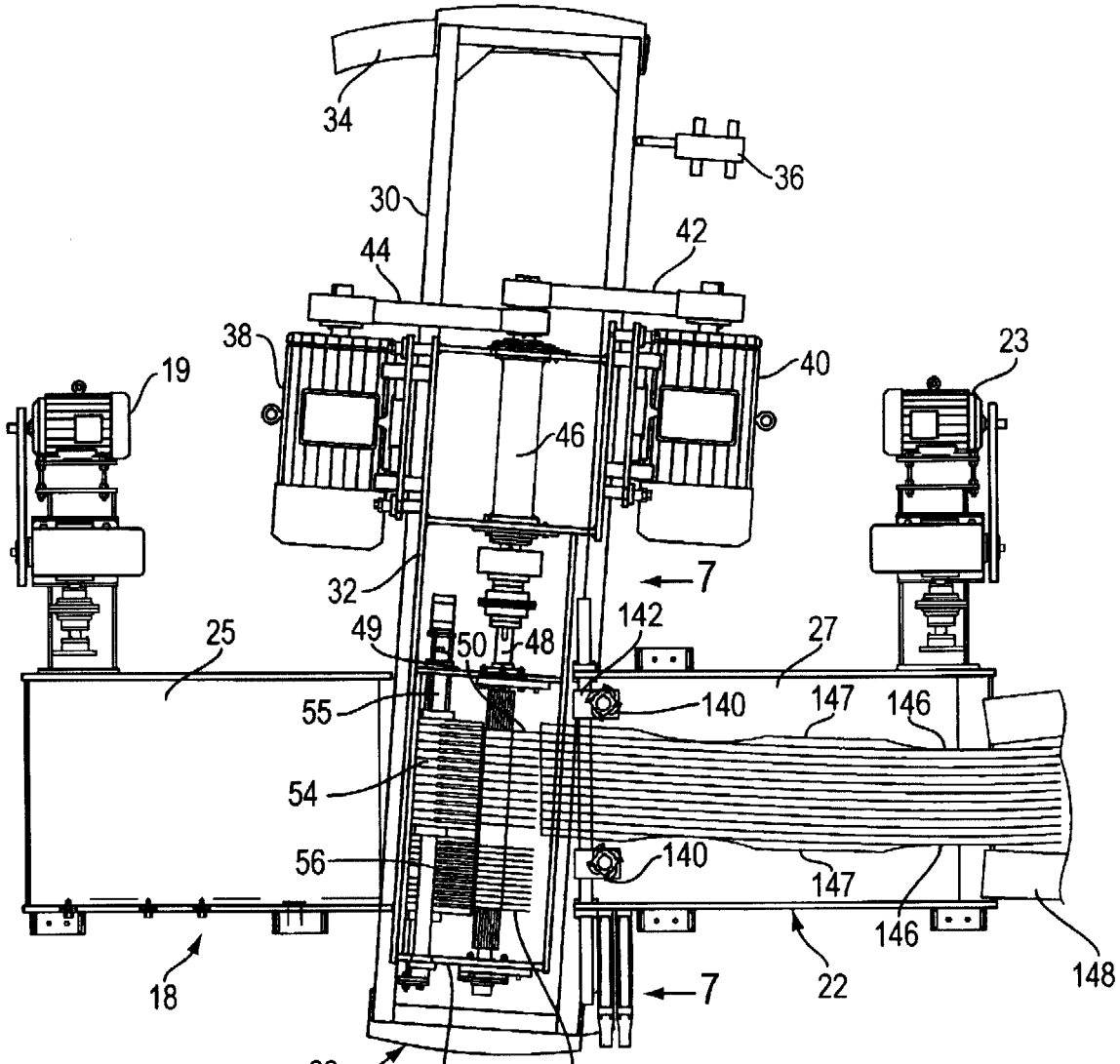
FIG. 2 is a top plan view in enlarged detail of the gang saw apparatus and some of the associated transport conveyors of the present invention.
Figure 7:
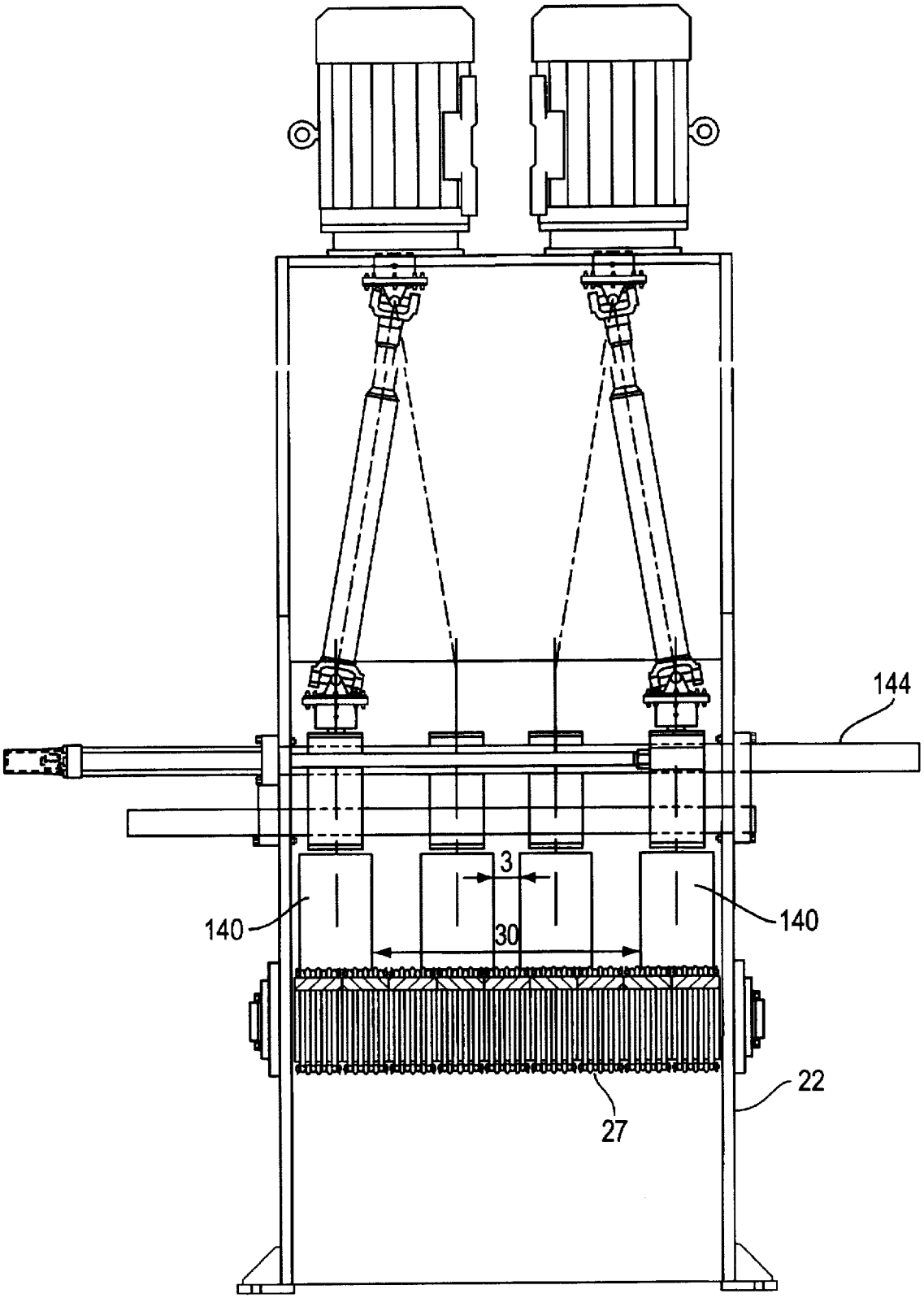
FIG. 7 is a view along lines 7—7 of FIG. 2.

As shown in FIG. 2, and more clearly in FIG. 7, the present invention provides a pair of chipper heads 140 which are vertically mounted so as to be rotatable about a vertical axis. The chipper heads 140 are mounted on slides, one of which is shown at 142 with each slide 142 slidably mounted on a rod 144. In a preferred embodiment the rod 144 and the sliders 142 are interthreaded so that rotation of the rod 144 in one direction will move the chipper heads 140 inwardly toward the workpiece W as shown in FIGS. 2 and 7, whereas rotation in the opposite direction will move the chipper heads 144 outwardly, also as shown in FIG. 7. With this arrangement, the outer uneven side edges of the workpiece 147 can be cut through as at 146 to substantially reduce the longitudinal length of the outer side boards 147 to facilitate their disposal in a separating table partially shown at 148 and on which the rollers will be provided which are appropriately spaced to allow the shortened side boards 147 to fall through by gravity. The rotation of the positioning rod 144 can be controlled by the computer, mentioned above, to control the spacing between the side cuts 146 to achieve any desired length or to eliminate such cutting, if desired, where there is a market for usually uneven outer side edges of a cant workpiece.

With reference now to FIG. 2, there is shown a top view with portions of the enclosure walls removed to illustrate the details of the infeed module 18, cutting tool module 20 and outfeed module 22. In an exemplary embodiment, the motors 19 and 23 for the respective conveyor modules 18 and 22 will be linked and controlled by a central control such as a computer so that the transport velocities of the conveyors 25 and 27 will be precisely correlated as these will control the transport of a workpiece W through the cutting tool module 20.

Figure 3:
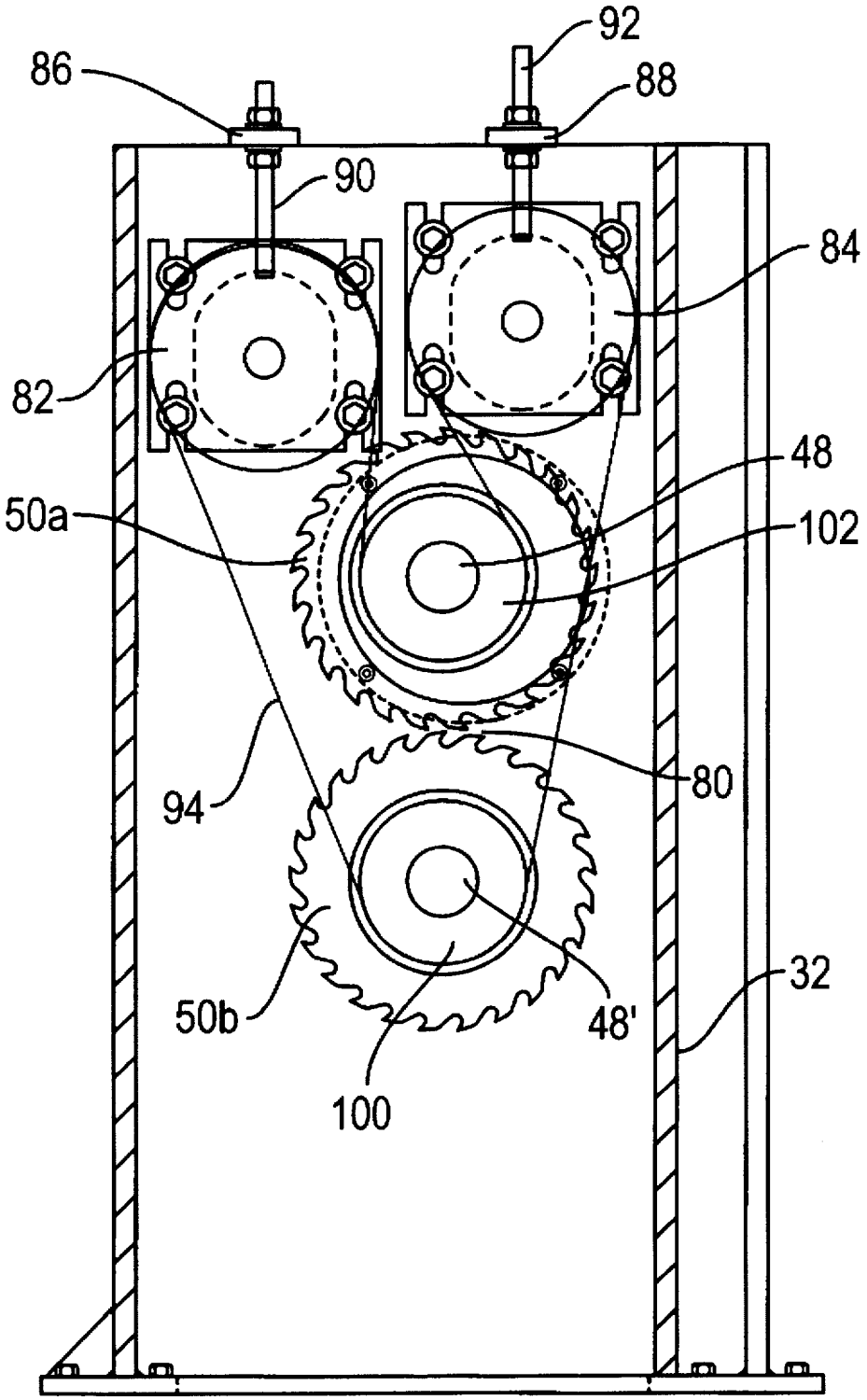
FIG. 3 is an interior view in elevation of the cutting tool module 32 showing disposition of the parallel arbors for the gang saws.
Figure 5:
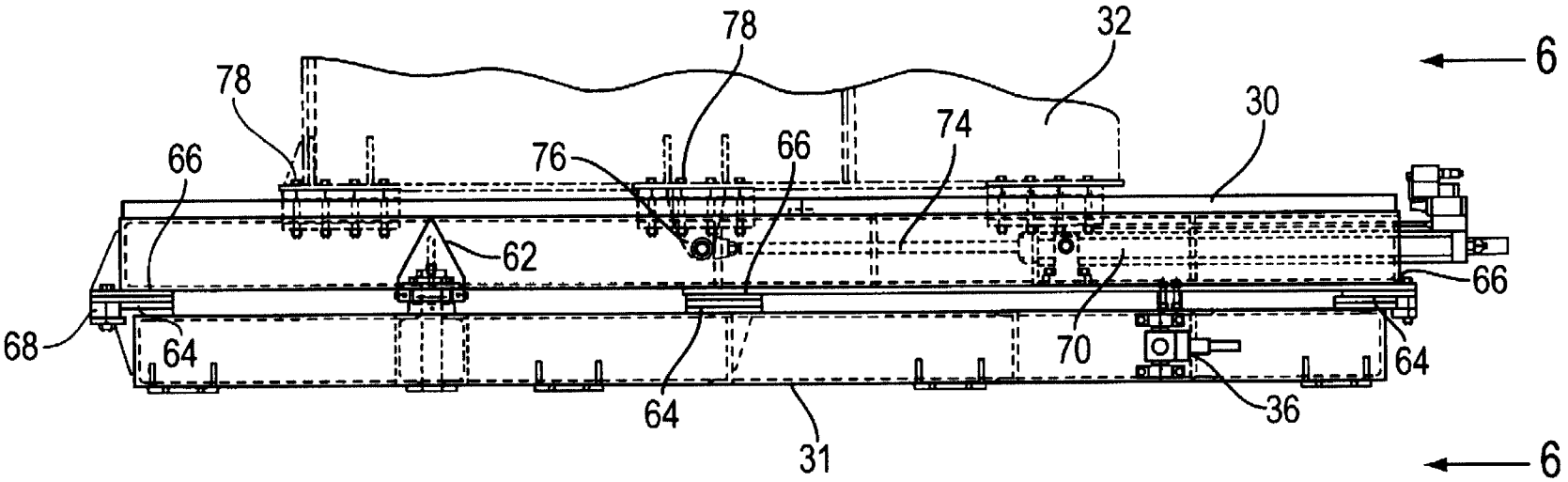
FIG. 5 is a side view in elevation of the carriage of FIG. 4.

The cutting tool module 20 includes an upper carriage 30 which is pivotally mounted on an undercarriage 31 which is fixed to the floor of a plant (FIG. 5). Supported on the carriage 30 are gang saw drive arbors one of which is shown at 48, a portion of which extends through a tubular housing 46. Outside housing 32, drive gears are mounted to receive belts 42 and 44 which are respectively driven by motors 38 and 40 each of which are mounted on the outer portion of the housing 32. The drive arbor 48 extends through an opening in a support wall 49 which will include a journal bearing to rotatably support the arbor 48. Interiorly of the wall 49, a pair of gang saws 50 and 52 are mounted in spaced relation. Vertically beneath the gang saws 50 and 52 an identical configuration for an under set of gang saws is also provided as indicated in FIG. 3. Also mounted fixedly between wall 49 and end wall 59 of housing 32 is a support rod 55 for supporting the saw guide plates 54 which are preferably fixed on rod 55 and provide slots each for receiving a saw blade to stabilize the operation of the blade as is conventional.

Figure 4:
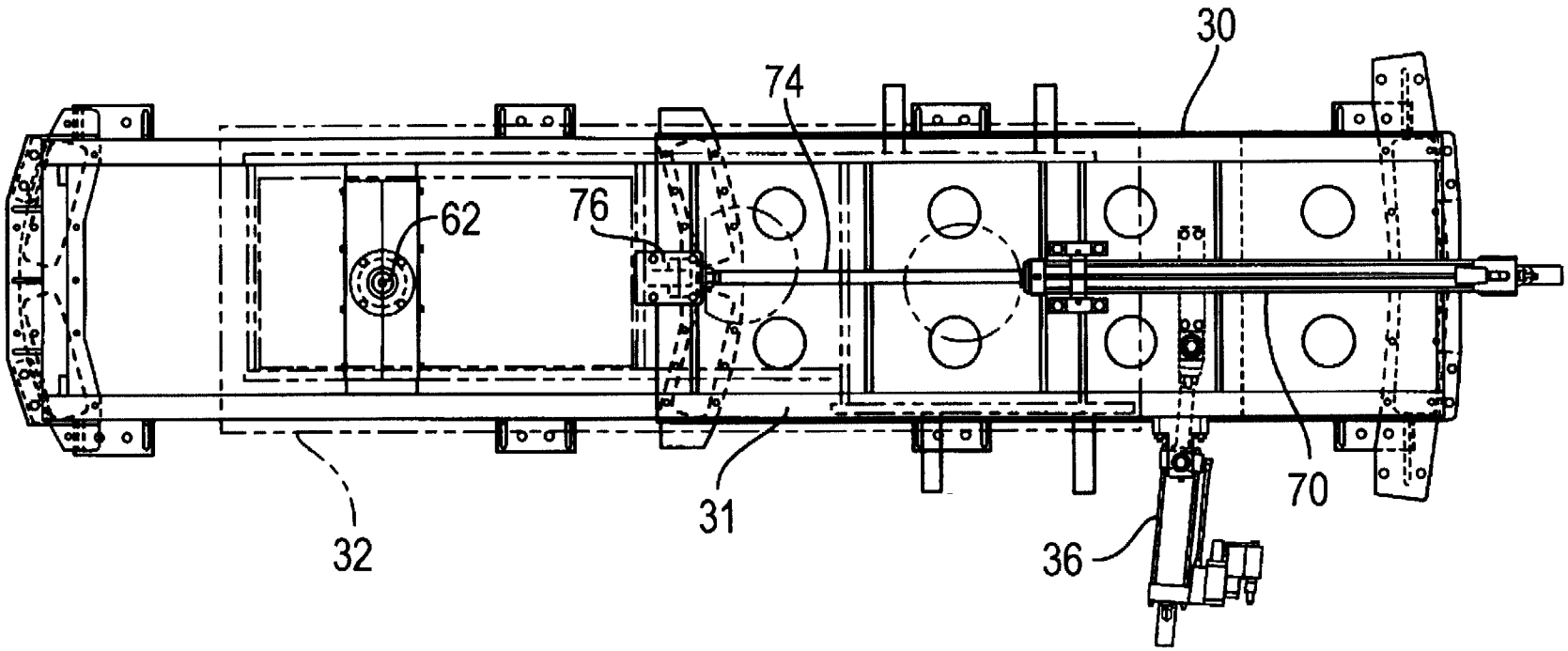
FIG. 4 is a bottom plan view of the carriage for the gang saw of the present invention.

As noted above, the carriage 30 is pivotally mounted on a support carriage 31 and to effect pivoting, a hydraulic piston and cylinder arrangement 36 is fixedly mounted on the support floor. As more clearly shown in FIGS. 4 and 5, the pivot 62 for the carriage 30 is located at approximately the midpoint between the two sets of gang saws 50 and 52 to facilitate positioning of the gang saws relative to the path of the workpiece. Additionally, the carriage 30 is supported on bearing plates 66 each of which in turn rests upon a bearing plate 64 provided on support platform 31. At the end of the carriage 31 remote from the pivot axis 62, the bearing plate is extended through an arc as shown at 34 in FIG. 2.

Additionally, the housing 32 is mounted on a slide on carriage 30 and is connected to a piston and cylinder arrangement including a piston rod 74 which is connected to the housing 32 through a lug 76. With this arrangement, actuation of the cylinder 30 in the usual manner will effect shifting of the housing 32 along a rectilinear path defined by the parallel side edges of the carriage 30. To facilitate mounting and allow longitudinal movement, the housing 30 will include lubricated bearing plates 78 at selected points along its base wall and which slidably engage the side edges of the carriage 30 as shown in FIG. 5. Preferably, the piston rod 74 will engage a lug 76 at a midpoint between the width of the housing 32 to effect smooth and uniform movement of the housing 32 along the carriage 30. Sliding of the housing 32 functions to bring one or the other of the pairs of gang saws into a working position to engage a cut a log. The gang saws, as shown have different spacing between the circular saws. Clearly, more pairs may be used and mounted on the arbors, if desired. Any required or desired correlation of the actuation of the piston and cylinder 36 for effecting pivoting movement of the carriage 30 about pivot axis 62 and actuation of the piston 70 for effecting translation of the housing 32 on the carriage 30 will be described below.

Figure 8:
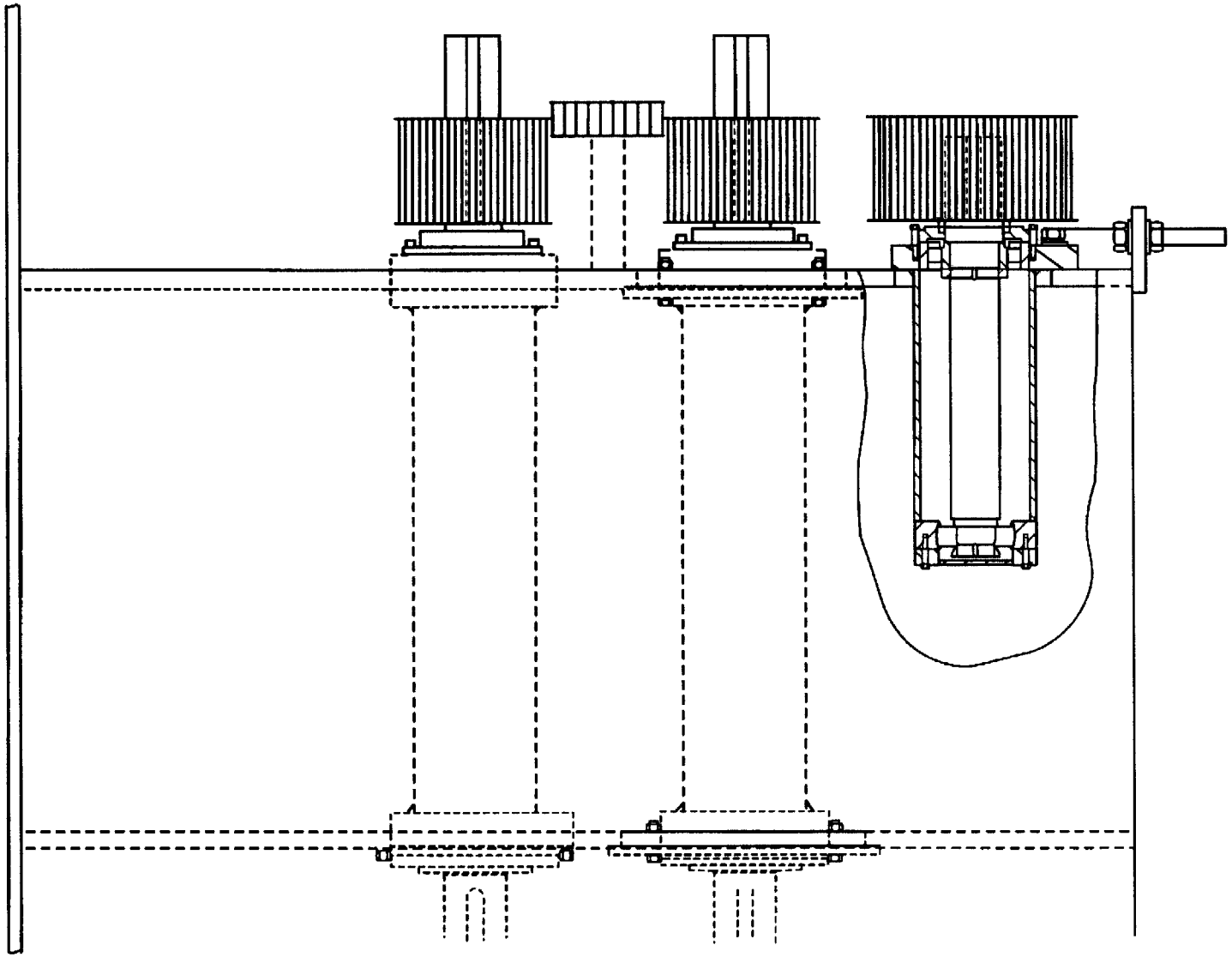
FIG. 8 is a side view of the arrangement of FIG. 3 but showing a gear transmission for driving the arbors 48 and 48'.

With reference now to FIG. 3, there is shown the upper and lower arbor of the gang saw, each of which carries a plurality of saw blades, one of which is indicated at **50*a* on arbor 48 and one at 50*b* on arbor 48'. The arbors 48 and 48' are positioned relative to the radius of the blades 50*a* and 50*b* so that the teeth of the blades will intermesh at the bite 80. With this arrangement, a timing mechanism is employed to assure that the blades do not contact. For example, to achieve this, the present invention provides the belting arrangement as shown in FIG. 3. Alternately, a gear transmission is shown in FIG. 8. In the arrangement of FIG. 3, two adjustable pulleys 82 and 84 are provided in the housing 32. The position of the pulleys 82 and 84 vertically in the housing 32 is variable by adjusting of nuts 86 and 88, respectively, on threaded rods 90 and 92. A single drive belt 94 is deployed about the pulleys and drivingly engages wheel members 100 and 102 provided on the arbors 48 and 48'. With this arrangement, when one of the arbors 48 or 48' are driven, the other arbor will be driven and rotated synchronously, preferably in an opposite direction. This will enable preadjustment of the intermeshing of the saw teeth of the blades 58 of each of the gangs, upper and lower, to avoid undue wear on the blade teeth. It will be appreciated, of course, that in some cutting operations, such close control of the sawing operation is not required, so that the saw blades may be spaced initially so that there is no intermeshing relationship at the bite 80. In this arrangement, a more common drive, as illustrated in FIG. 2** may be employed.

Figure 6:
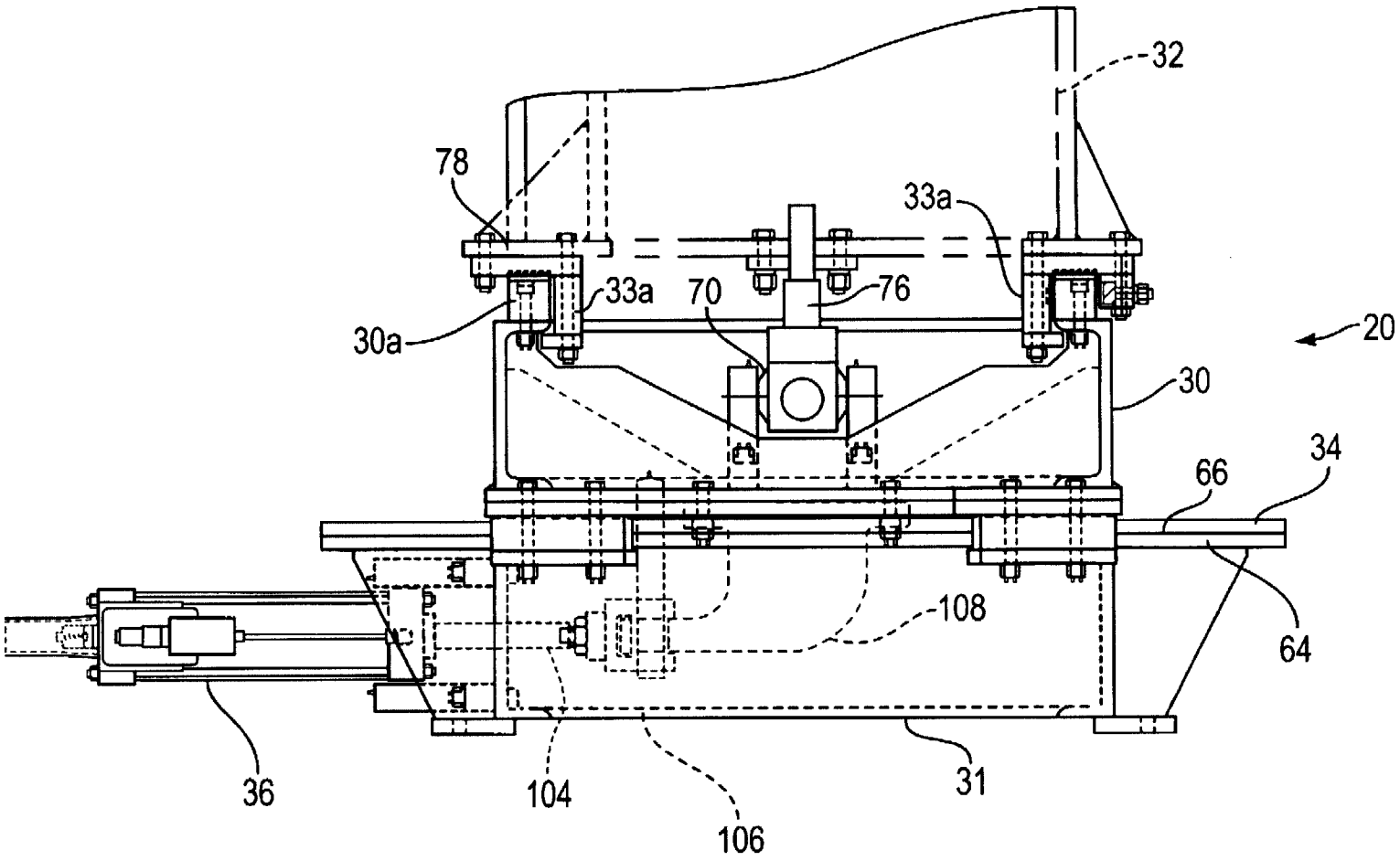
FIG. 6 is an end view taken along lines 6—6 of FIG. 5.

Referring now to FIG. 6, there is shown an end view of the cutting tool module 20 of the present invention. As shown, the cylinder 36 includes a piston rod 104 which is journaled through a yoke 106 to the end of a bent arm 108, the opposite end of which is securely bolted to the base of carriage 30 to enable effective transfer of pivoting motion from the piston 36 to the carriage 30 on the bearings 66 and 64. Similarly, there is shown the provision of the bearing plate 78 resting on the upper side edges **30*a* of the carriage 30 together with the underside retaining arms 33*a* provided along the bearing plates 78 to stabilize the housing 32 in use and during transport as a result of actuation of the cylinder 70**.

In a preferred arrangement, control of the speed of the apparatus may be made subject to a computer control where the software will be linked to inputs from photodetectors activated by a log breaking a path from a source of light located on one side of the path of the log to a photodetector. For example, with reference to FIG. 1, supply of log W from the supply conveyor 12 to the optical scanner 14 can be automatically effected by a photocell detector 120 which is located downstream of the scanning work station 14. That is, when the photodetector is activated by the passage of a log, the supply conveyor motor will be activated to effect passing a subsequent log to the scanning work station 14. Similarly, the photocell 122 may be positioned downstream of the table 16 on opposite sides of the workpiece path 28, so that when a light beam from a source 126 is broken by a log fed from the table 16, the conveyor of the infeed module will be activated. Correspondingly, since the breaking of the optical path between the source 126 and the detector 124 will locate for the software the end position of the workpiece W, a known distance will then exist between the optical path and the pivot axis 62 of the cutting tool module 20.

In the scanning operation at the work station 14, in a preferred method of operation, a canted log, that is one where at least two opposite sides have been cut to be substantially parallel are provided. One of these sides will be positioned as a downwardly facing side, and the opposite side will be upwardly facing. A series of scanners and corresponding detectors are located on opposite sides of the path of travel through the optical scanning work station 14. These detectors and optical light sources may be located a fixed distance along the length of the logs to be cut. Once scanned, information relating to the curvature of the log on opposite sides of the log will be derived automatically and fed to a computer such as at 130 by suitable cable 132. The computer 130 will be preferably programmed to derive solutions to a cubic equation which will approximate the curvature of the workpiece cant W. It has been found that a cubic equation will give the best fit to the largest quantity of logs that are presented for sawing. Clearly, filters will be required in the software to prevent actuation of the apparatus where the dimensions including the curvature of the log presented or scanned exceeds certain limits, as is conventional in these types of operation. The solution to the cubic equation will use a linear regression technique to find a third order polynomial expression which best matches the face lines on both sides of the workpiece together with a mathematical expression for the points midway between the face lines. Such a curve can be represented as follows $$Y=AX^3+BX^2+CX+D.$$

Preferably, the software is provided with a set of filter limits within which a board's dimensions must fit in order for cutting to commence. In addition, if the angle of the curve of the log is exceeded, as noted above, the curves can be recalculated until an acceptable solution is achieved. The highest value solution which does not violate any mechanical limitations of the apparatus will be selected as the final result. The computer will then commence feeding of the log to the selected gang saw and the computer will control operation of a solenoid operated valve in a hydraulic system 142 in a hydraulic line leading to the cylinder 36 so that the supply of hydraulic fluid will be controlled to pivot the carriage 30 and will be correlated with the longitudinal movement of the log along the path 28 past the pivot point 62 so that the maximum number of boards will be cut taking into consideration the curvature of the log per selected unit of length as determined by the software.

With the foregoing, rapid and accurate cutting of a greater variety of logs can be achieved thereby increasing the availability of harvestable logs for commercial use.

Figure 9:
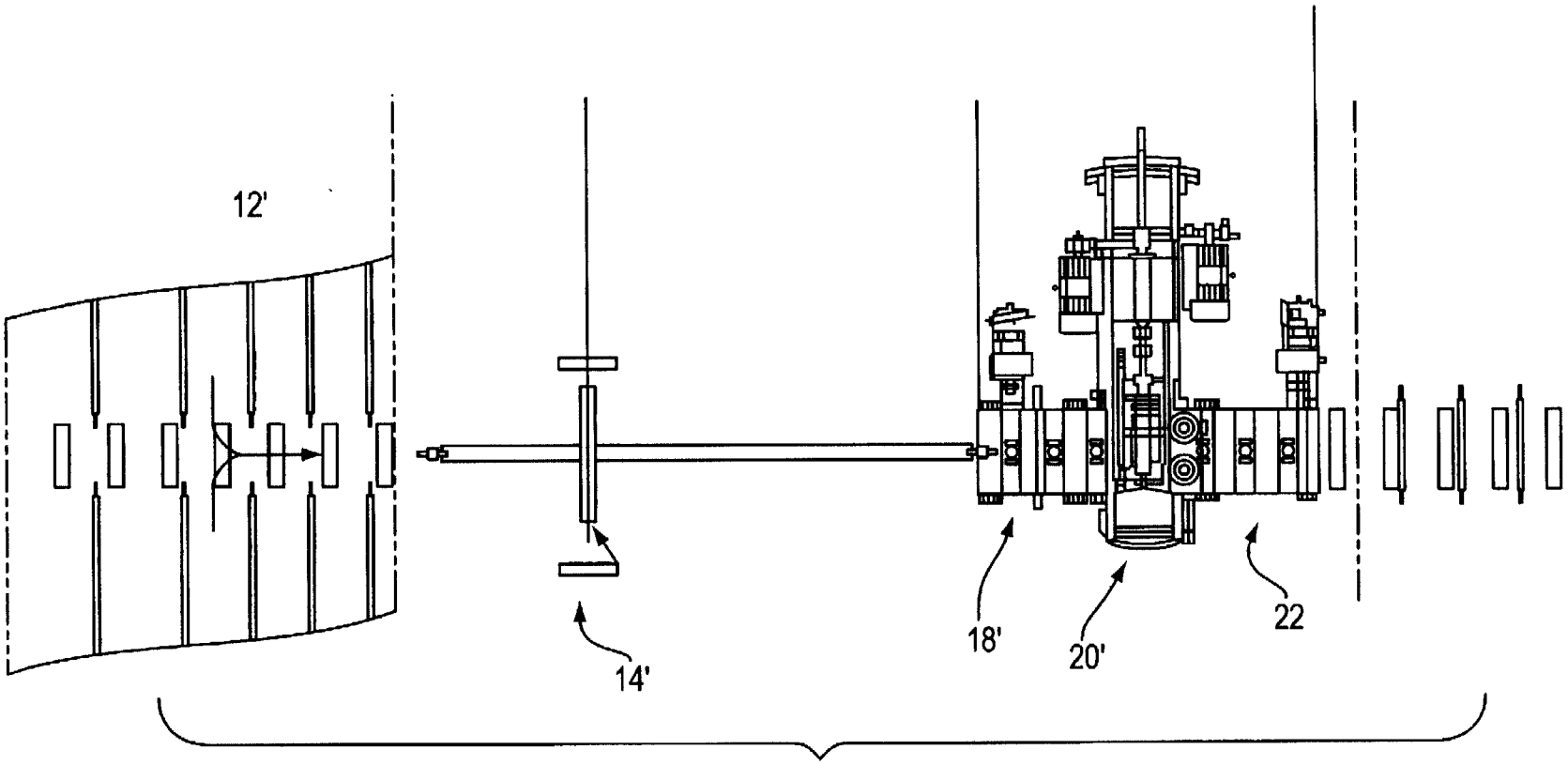
FIG. 9 is a schematic illustration, similar to FIG. 1, but showing an alternate arrangement of the apparatus of the present invention.

It will also be apparent from the foregoing that other dispositions of the modules of the present invention can be utilized. For example, as shown in FIG. 9, the scanning position 14' can be placed anywhere downstream from a supply 12' of logs with an orienting table positioned anywhere between the scanning position 14' and the infeed module 18'.

Having described the invention, it will be apparent to those skilled in this art that various modifications may be made therein without departing from the spirit and scope of this invention as defined in the appended claims.

What is claimed is:

1. An apparatus for cutting a workpiece into parts of desired dimensions where the workpiece has non-uniform original dimensions comprising: a transport conveyor for moving the workpiece along a path through a plurality of stations;

said plurality of stations including a workpiece scanning station including sensing means for sensing the dimensions of the workpiece and processing means associated with said sensing means for analyzing the sensed dimensions provided by said sensing means and providing an apparatus control instruction;

a cutting station including a cutting tool mounted on a carriage, said carriage being pivotally movable relative to said transport conveyor to vary the position of said cutting tool relative to a workpiece being carried by said transport conveyor past said cutting tool and along said path;

means for moving said carriage relative to said path with said processing means controlling actuation of said means for moving said carriage in accordance with said apparatus control instruction.

2. The invention as claimed in claim 1 wherein said sensing means comprises a plurality of optical imaging members and radiation sources with a said imaging member being associated with a said radiation source and positioned to effect a scan of the surface of the workpiece to detect at least the length, width and surface contour of the workpiece.

3. The invention as claimed in claim 2 wherein said sensing means, upon effecting a scan of the workpiece, delivers dimensional data to said processing means, said processing means including computing means for deriving said apparatus control instruction in accordance with selected cutting criteria.

4. The invention as claimed in claim 1 wherein said carriage is mounted on a platform and is movable linearly on said platform between two positions and said platform is pivotally mounted on a base so as to be rotationally movable relative to said base and said path.

5. The invention as claimed in claim 1 wherein said cutting tool is a set of circular saw blades mounted on a common drive shaft rotatably mounted on said carriage.

6. The invention as claimed in claim 5 wherein a motor is provided on said carriage for driving said common drive shaft.

7. The invention as claimed in claim 5 wherein another set of circular saw blades are mounted on another drive shaft rotatably mounted on said carriage and extending parallel to said common drive shaft, said common drive shaft being located vertically above said path and said another drive shaft being located vertically below said path, each saw blade having evenly spaced teeth about the periphery thereof, the teeth of each saw blade mounted on said common drive shaft intermeshing with said teeth of a said saw blade located on said another drive shaft.

8. The invention as claimed in claim 6 wherein said drive shafts are connected to said motor by a common drive member.

9. The invention as claimed in claim 7 wherein each drive shaft includes a sprocket gear and said common drive member is a sprocket chain looped about each said sprocket gear with said motor drivingly engaging said sprocket chain.

10. The invention as claimed in claim 4 wherein said cutting tool includes at least two sets of circular saw blades mounted on a common drive shaft rotatably mounted on said carriage and driven by a motor also mounted on said carriage, the spacing between said saw blades of one set being greater than the spacing between said saw blades of the other of said sets so that, with said carriage in one of said two positions, one of said sets will be located in a cutting position relative to said path.

11. The invention as claimed in claim 4 wherein said cutting tool comprises two drive shafts mounted for rotation on said carriage with one drive shaft located vertically above and said other drive shaft located vertically below said path with said drive shafts extending parallel to one another, each drive shaft having two spaced apart sets of circular saw blades mounted thereon with the saw blades of one set having a selected spacing between said blades of said one set and with the saw blades located vertically below said one set on the other drive shaft having the same selected spacing.

12. The invention as claimed in claim 11 wherein, said saw blades each have peripheral cutting teeth and said teeth of a blade located on one drive shaft intermesh with said teeth of a blade located on the other of said drive shafts.

13. An apparatus for cutting a workpiece into parts of desired dimensions where the workpiece has non-uniform original dimensions comprising:

a transport conveyor for moving the workpiece along a path through a plurality of stations;

said plurality of stations including a workplace scanning station including sensing means for sensing the dimensions of the workpiece and processing means associated with said sensing means for analyzing the sensed dimensions provided by said sensing means and providing an apparatus control instruction;

a curing station including a cutting tool mounted on a carriage, said carriage being movable relative to said transport conveyor to vary the position of said cutting tool relative to a workpiece being carried by said transport conveyor past said cutting tool and along said path;

means for moving said carriage relative to said path with said processing means controlling actuation of said means for moving said carriage in accordance with said apparatus control instruction, said carriage being mounted on a platform and said platform being pivotally mounted on a base so as to be rotationally movable about a pivot axis relative to said base.

14. The invention as claimed in claim 13 wherein said pivot axis of said platform is located vertically below said path and lies along a line that intercepts said path.

15. The invention as claimed in claim 14 wherein said platform has an end remote from said pivot axis, a bearing surface being provided between said platform and said base at said end of said platform.

16. The invention as claimed in claim 15 wherein said means for moving said carriage includes an hydraulic piston and cylinder operating between said base and said platform and located adjacent said end of said platform.

17. A method of forming a workpiece into sectioned parts using a cutting device of the type having a plurality of rotatable cutting members mounted for rotation on a common axis which is movable and including workpiece transport means for moving the workpiece from a starting position to a final position along a path which extends past the cutting device, comprising the steps of:

(a) passing the workpiece from the starting position through a scanning position;

(b) scanning the workpiece with a detection device to determine dimensional information of the workpiece;

(c) sending the dimensional information to a computing device which analyzes the dimensional information and calculates a cutting solution for the scanned workpiece;

(d) passing the workpiece from the scanning position toward the cutting device while orienting the workpiece for movement through the cutting device substantially along a linear axis of movement;

(e) engaging the workpiece with the cutting device by passing the workpiece past the cutting device while controlling the rotational position about the common axis of the cutting device in accordance with the cutting solution; and (f) transporting the workpiece and sectioned parts from the cutting device.

* * * * *